US006386130B1

(12) United States Patent
Kuehne

(10) Patent No.: US 6,386,130 B1
(45) Date of Patent: May 14, 2002

(54) CONTROL SYSTEMS FOR SAILING VESSELS

(76) Inventor: Donald A. Kuehne, 425 W. 2nd St., Tustin, CA (US) 92780

( * ) Notice: Subject to any disclaimer, the term of this patent is extended or adjusted under 35 U.S.C. 154(b) by 0 days.

(21) Appl. No.: 09/643,246

(22) Filed: Aug. 22, 2000

(51) Int. Cl.[7] ..... B63B 35/00

(52) U.S. Cl. ..... 114/39.26; 114/39.28; 114/124; 114/363

(58) Field of Search ..... 114/363, 124, 114/39.12, 39.21, 39.26, 39.28, 39.29

(56) References Cited

U.S. PATENT DOCUMENTS

| | | | | | |
|---|---|---|---|---|---|
| 2,112,171 | A | * | 3/1938 | Marlow | 114/39.25 |
| 2,238,464 | A | * | 4/1941 | Fletcher | 114/39.25 |
| 4,539,926 | A | * | 9/1985 | Boffer | 114/39.15 |
| 4,852,507 | A | * | 8/1989 | Ryon et al. | 114/39.26 |
| 4,936,236 | A | * | 6/1990 | Sinden | 114/39.25 |
| 5,320,060 | A | * | 6/1994 | Gunter | 114/363 |
| 5,355,817 | A | * | 10/1994 | Schrems | 114/39.28 |
| 5,377,607 | A | * | 1/1995 | Ross | 114/39.12 |
| 6,079,344 | A | * | 6/2000 | Wang et al. | 114/39.12 |
| 6,112,693 | A | * | 9/2000 | Addison | 114/347 |

FOREIGN PATENT DOCUMENTS

| | | | | |
|---|---|---|---|---|
| DE | 3339883 A1 | * | 5/1985 | 114/39.15 |
| DE | 3403706 A1 | * | 8/1985 | 114/39.25 |
| EP | 000-4796 | * | 10/1979 | 114/39.25 |
| FR | 2625473 | * | 7/1989 | 114/39.25 |
| GB | 2154183 | * | 9/1985 | 114/39.25 |
| WO | 90/11219 | * | 10/1990 | 114/39.25 |

* cited by examiner

*Primary Examiner*—S. Joseph Morano
*Assistant Examiner*—Ajay Vasudeva

(57) ABSTRACT

An improved control system for a sailing vessel for controlling the position of the sail and the rudder, and affixed to a slidable seat apparatus. A movement of the seat apparatus does not alter the position of the sail or the rudder. A ballast control, steering control and sail control are located on the slidable seat apparatus. The slidable seat apparatus provides a ballast control means using the helmsperson's weight and the seat itself as movable ballast. Furthermore, the steering control and the sail controls are mounted to the movable seat and are operable independently and simultaneously with the movement of the seat. A base provides a base connection means for the seat, and in the case of a multi-hull embodiment of the sailboat, the base is substantially in the form of a scissoring "X" shape. The scissoring base functions as both a connecting means and a means to adjust the distance between the hulls for operation or storage. The connection of the scissoring base to the hulls provides a longitudinal adjustment of the entire control apparatus relative to the hulls.

12 Claims, 4 Drawing Sheets

CONTROL SYSTEMS FOR SAILING VESSELS

BACKGROUND OF THE INVENTION

The present invention relates to improved control systems for sailing vessels.

There has long been a need for an integrated control system for commanding small sailing vessels that offers comfort, high performance and ease of operation. The effects of various wind and water conditions on sailing vessels can create a variety of situations where a quick and accurate response is critical. Such a need can be met by an integrated approach at vessel control. The ability of making changes to such variables as steering, sail control and ballast in an independent and simultaneous fashion from a comfortable seat is desirable.

To better understand and appreciate the features of this invention it would be useful to discuss some of the basic aspects about the control of small sailing vessels.

The control of a small sailing craft requires swift and independent control of three primary variables. Other variables, such as the control of lateral resistance and sail shape, are useful for controlling a sailing vessel and can be controlled in a similar fashion using the control mechanisms disclosed in this invention, but they are not essential and are therefore not discussed.

The first of the three primary control variables is control over a steering system that effects changes in the course of the vessel. Steering is typically controlled by the pivoting of a rudder or rudders located substantially toward the aft of the vessel.

The second primary vessel control variable is control over the angle of the sail/airfoil assembly to the wind known as the angle of attack. A sail assembly can have a mast and boom and sail or various other configurations that act substantially together like a wing to provide power to the sailing craft. Limiting the sail's natural tendency to pivot or "vane" away from the wind most commonly accomplishes this control means. A single line, known as the mainsheet, can be used to control a sail. The main sheet is typically rigged such that the pulling, or tightening of the free end of the main sheet draws the aft portion of the sail to a position substantially parallel with the hulls. Because the forward end of the sail is fixed laterally and longitudinally but is allowed to pivot freely, limiting the displacement of the aft end of the sail will provide the angular control of the sail relative to the wind direction.

Thirdly, it is necessary to control ballast on the vessel to counteract the forces of the wind that tend to tip the vessel. This tendency to tip is caused by the force of the wind acting upon the sail and other exposed surfaces of the vessel. The greater the wind force acting on the sail and other surfaces, the greater the tendency to tip the vessel depending on the angle of the wind to the vessel. The forces created by the wind will also affect the pitch of the vessel forward and backwards in addition to the heeling of the vessel to either side. To counteract this rotation of the vessel, a counterweight in the form of moveable ballast can be used to balance these forces fore and aft and port and starboard (front and back and left and right).

An increase in wind power translates into more driving power. Therefore, if one can use moveable ballast to counteract the wind forces that cause extreme changes in pitch and heeling, one can accommodate additional force exerted by the wind causing the vessel to move faster. If the wind forces are not counteracted, the wind force will cause excessive changes in pitch and heeling, reducing sailing efficiency, thus causing the vessel to lose velocity, and in extreme cases causing the vessel to capsize.

A sailing vessel will move more efficiently and will have better performance if it is lighter. On a small sailing vessel it is therefore advantageous to use the helmsperson's weight as moveable ballast to counteract the overturning wind forces. This is preferable to using fixed weights, such as stationary or mechanical ballast as is common with larger sailboats. Using the helmsperson's weight as ballast traditionally requires the helmsperson to travel from one side of the boat to the other and forward and back, whenever he or she needs to counteract the overturning wind forces. These gymnastic type moves have helped portray the sport of small vessel sailing as difficult if not dangerous. This situation is compounded by the fact that the helmsperson must also be addressing all the other control variables at the same time with the failure to control any one of the three primary variables will result in loss of power, loss of directional control, or excessive tipping that can lead to capsizing or a combination of all three. Effects of momentum, waves and intermittently changing wind direction and power further complicate the dynamics of sailing vessel control.

It is therefore necessary to have swift and independent control over all these variables alone and in combination to improve response and comfort while increasing performance and safety. For example, during a common sailing maneuver known to sailors as "tacking", the course of the vessel relative to the direction of the wind is altered, such that it causes the sail to substantially change sides of the vessel. To accomplish this maneuver the helmsperson makes a course correction by affecting a change on the rudder, or rudders, while simultaneously adjusting the position of the sail. Depending on the strength of the wind and the rapidity at which the course correction is made, the helmsperson will adjust his or her weight as ballast before, during or after the final course correction has been completed. During the course correction the sail will assume a new position relative to the vessel effectually switching the side upon which the lateral wind force acts.

Traditional sailing vessels without movable seats generally require ballast to be moved from one side of the boat to the other and forward or aft to optimize performance in a maneuver such as tacking. On small sailing vessels this ballast consists almost exclusively of the helmsperson and crew. Using built-in mechanisms such as substantially wider hulls or weighted keels, limit the portability and maneuverability of a small sailing vessel. Therefore, it is desirable to make use of the helmsperson's weight as ballast to reduce the overall weight of the vessel.

Continual corrections are needed to all of the primary control variables even when sailing substantially straight since the waves, momentum of the vessel, and the wind's direction and strength are constantly changing. It is therefore essential that a helmsperson have the ability to make any and all of these changes swiftly and independently to more efficiently control the sailing vessel. A control system that allows a helmsperson to manage the primary control functions independently and in a timely manner is imperative to maximize performance.

This present invention integrates each of these primary control variables into a comfortable moving seat. This present invention is more than just the sum of its parts, since only when all control means are integrated into the moving seat are the full benefits realized.

One partial attempt at controlling a vessel is identified in U.S. Pat. No. 4,936,236 to Sinden. In that patent, the sail, boom and seat form a fixed assembly that can pivot about the mast. As the assembly pivots, it changes the horizontal position of the helmsperson sitting on the seat portion to counter the force of the wind. The helmsperson's seat is on a track and can move inward and outward in relation to the mast. The helmsperson uses rudder lines to control the rudders. There is also a control mechanism that the helmsperson can use to pivot the seat/sail/boom assembly about the lateral axis of the mast.

The Sinden control arrangement has numerous drawbacks. The helmsperson must always be facing perpendicular to the sail boom and is forced to pivot when the sail moves. The seat's position is not independent, but rather is directly tied to the motion of the sail assembly. Thus, the ballast control is directly tied to the sail control in Sinden's invention. It is necessary to separate these two control means to efficiently command a small sailing craft as described above. While the helmsperson can pivot about the lateral axis of the mast, the helmsperson cannot move independent of the sail.

Movement by the helmsperson linearly along a track towards or away from the mast requires the helmsperson to adjust the length and tension on the steering reigns and sail controls. Compensation for the motion of the seat is required to maintain steering control as Sinden's concept does not provide a steering control that is operable independent of the movement of the seat.

Finally, the patent is directed to boats known as a "proa". A proa is a special class of boat that does not sail across the wind, but rather uses symmetry to sail both forward and backwards. Changing direction relative to the wind requires using a turn called a "shunt" to sail in a different direction. In this maneuver the boat actually stops and changes direction front to back. Sinden's vessel is directed to such a boat and has limited relevance on a standard sailing craft such as the one disclosed in the present invention.

U.S. Pat. No. 5,884,575 to Talasimov discloses a swinging nautical balancing system and chair mounted on a rail system. Talasimov teaches about balancing the heeling forces on a sailboat with the helmsman's weight. Unfortunately, Talasimov fails to consider the control of the vessel's sails and steering. On small crafts Talasimov's balancing system is cluttered, unnecessarily complex and heavy. Talasimov teaches that the support rails are necessary to reduce stress on the sailboat deck. Talasimov teaches that the pivot point of a pivoting seat must be separated from the pivot point of the sail assembly to increase performance, but this is more a function of hull and sail design than ballast control. The size, shape and buoyancy of the hulls and sail dynamics can have much more to do with the balance forward and aft on a sailing vessel than moveable ballast.

Talasimov, also failed to realize that a frame or base plate could disperse the force on the deck eliminating the need for a rail system. Talasimov teaches a tiller for a steering means, which is awkward while moving across the deck during the sailing activity. Talasimov fails to provide an integrated sailing control system where the controls of the sail and steering move with the seat and are operable simultaneously and independently of each other and the movement of the seat.

U.S. Pat. No. 1,885,247 to Fox discloses a sailing vessel with a seat that can pivot about the lateral axis of the mast. Two rudder lines are available to the helmsperson to change the position of the rudders. Two more lines control a pivoting centerboard. There are also control lines on each side of the helmsperson for controlling the movement of the sail. In all, the helmsperson must contend with six lines in the control of the vessel. With only two hands, this presents a very definite problem. The problem is compounded by the fact that as the sliding seat moves toward and from the mast, the helmsperson must continually make adjustments to the lines to accommodate the change in seat position. Fox therefore fails to address the need to have the steering and sail controls function independent of the moving seat used for ballast control.

Another method of controlling a sailing vessel is found in U.S. Pat. No. 4,852,507 to Ryon et al. In this patent, steering, mast and sail wing controls are available to the helmsperson. A sail wing control pivots the sail wing of this invention from a horizontal to a vertical position and the mast control pivots the mast and the sail assembly. However, the helmsperson's seat is not capable of moving. Thus, Ryon et al. fails to provide a needed moveable seat for use as a ballast control. As a result, Ryon et al. fails to provide a moving seat to provide a comfortable and integrated approach to sailing vessel control.

U.S. Pat. No. 4,294,184 to Heinrich identifies a multi-hull vessel where the distance between the hulls can be varied for operation and storage and a wheel is placed in front of the seat to steer the craft. Heinrich's patent does not use a scissoring arrangement to control the distance between the hulls to set the hulls for operation. Furthermore, to set the hulls in position for operating or storage, the Heinrich patent requires the hulls be folded upward in semicircular path. This changes the height of the helmsperson over the surface of the water and in relation to the hull used for steering, thus raising the vessel's center of gravity. The higher the center of gravity reduces the helmsperson's ability to counteract the forces that cause heeling and makes capsizing more likely. Furthermore, Heinrich's patent can only reduce the width of the minimized adjustment as far as the width of the attached base section, whereas the present invention can completely close the distance between the hulls, since the base acts as both hull adjustment and hull connection. Moreover, Heinrich's sailboat does not allow the seat to move and so does not address the control system integrated into a moving seat.

U.S. Pat. No. 4,539,926 to Boffer, a rotating seat and rudder control is disclosed. In that patent, the seat is brought back to a longitudinal position by use of a spring. The seat is pivoted by the helmsperson pulling cables with his arms. The helmsperson must have sufficient arm and upper-body strength to pivot the seat. Unfortunately, the helmsperson cannot use his/her legs to assist in rotating because foot pedals operate the rudder control. Any foot pressure would change the direction of the rudder. This makes the pivoting of the seat burdensome and potentially dangerous, since the operator is required to use his legs for the awkward combination of balancing himself or herself on the seat and steering. An effort to regain balance could result in an unwanted course correction.

Since the arms are used to pivot the seat, the hands are not free to operate other controls. The Boffer patent does not address the situation where the sail control means move with the seat. Furthermore, the linear motion of the seat on the seat arm is not independent of the pivoting of the seat arm thus forcing the seat to move slidably along the seat arm. This eliminates the ability of the helmsperson to adjust his or her weight forward and aft independent the ballast adjustment laterally. The results of these limitations is the same as is seen in the other patents, that being, Buffer's control means must be adjusted as the seat moves and the controls are not available independently and simultaneously.

It is apparent that the methods of controlling a sailing vessel as disclosed by the prior art are not adequate. None of the inventions cited are directed at a sailing chair control system that provides sail control, steering control and ballast control integrated into a comfortable moving seat, where each control is operable independently, simultaneously and without the need for adjustment regardless of the positioning of the seat. Furthermore, no previous inventions use a scissoring base as a way to connect the hulls and control the distance between the hulls for operation and storage of a multi-hull vessel.

SUMMARY OF THE INVENTION

The present invention addresses a control system for sailing vessels. The system comprises a base and seat assembly including a slidable seat apparatus. In the case of a multi-hull vessel, the base is a scissoring construction. The seat assembly provides a seating means as well as a means to control the sailing vessel. Integrated into the seat assembly are controls for controlling the ballast, the steering and the sail of the vessel.

The controls are mounted on the slidable seat apparatus, such that they move with the seat apparatus and are operable independently and simultaneously regardless of the position of the seat. This allows the helmsperson to change the control settings in any location occupied by the slidable seat apparatus. Furthermore, there is no need to adjust the controls to compensate for the motion of the seat. More particularly, the controls are affected only by the manipulation by the helmsperson, not the movement of the slidable seat apparatus.

The sailing vessel of the present invention also includes a scissoring base for use with multi-hull sailing vessels. The scissoring base is attached between the hulls and varies the distance between the hulls. The scissoring base functions to provide a structural hull connection means, a pivotal sail mounting means, a seat apparatus connection means and hull separation adjustment means.

Accordingly, several objects and advantages of this present invention are to provide a comfortably easy to use sailing control system. This present invention integrates a ballast control, steering control and sail control into a comfortable moving helmsperson's chair.

This present invention can be adapted to a plurality of hulls. This present invention can be assembled, disassembled and used without the need for tools. This present invention provides a complete command system with the needed controls integrated into a moving chair. Each of the individual control elements are ergonomically positioned for easy access at all points of sail. The helmsperson steers with a lever, adjusts the sail with a line and balances the hull with his weight, all while seated in a comfortable recumbent chair, thus providing a more natural and comfortable sailing experience than the prior art sailing control systems.

Thus, the present invention overcomes the disadvantages of the prior art by incorporating all of the sailing controls in a single integrated moving seat. Additionally, this present invention does not require the added weight and complexity of the prior art sailing chairs. Moreover, this present invention does not require the helmsperson to adjust the steering or sail controls to compensate for the movement of the seat.

Lastly, this present invention is smaller, lighter and has fewer parts than the prior art sailing control systems, yet it is easier to use. Even though this invention has fewer parts and is smaller and lighter than the previous art, it provides better performance and more comfort features than the prior art.

Still further objects and advantages will become apparent from a consideration of the ensuing description and accompanying drawings.

DETAILED DESCRIPTION OF THE INVENTION

Figure 1:
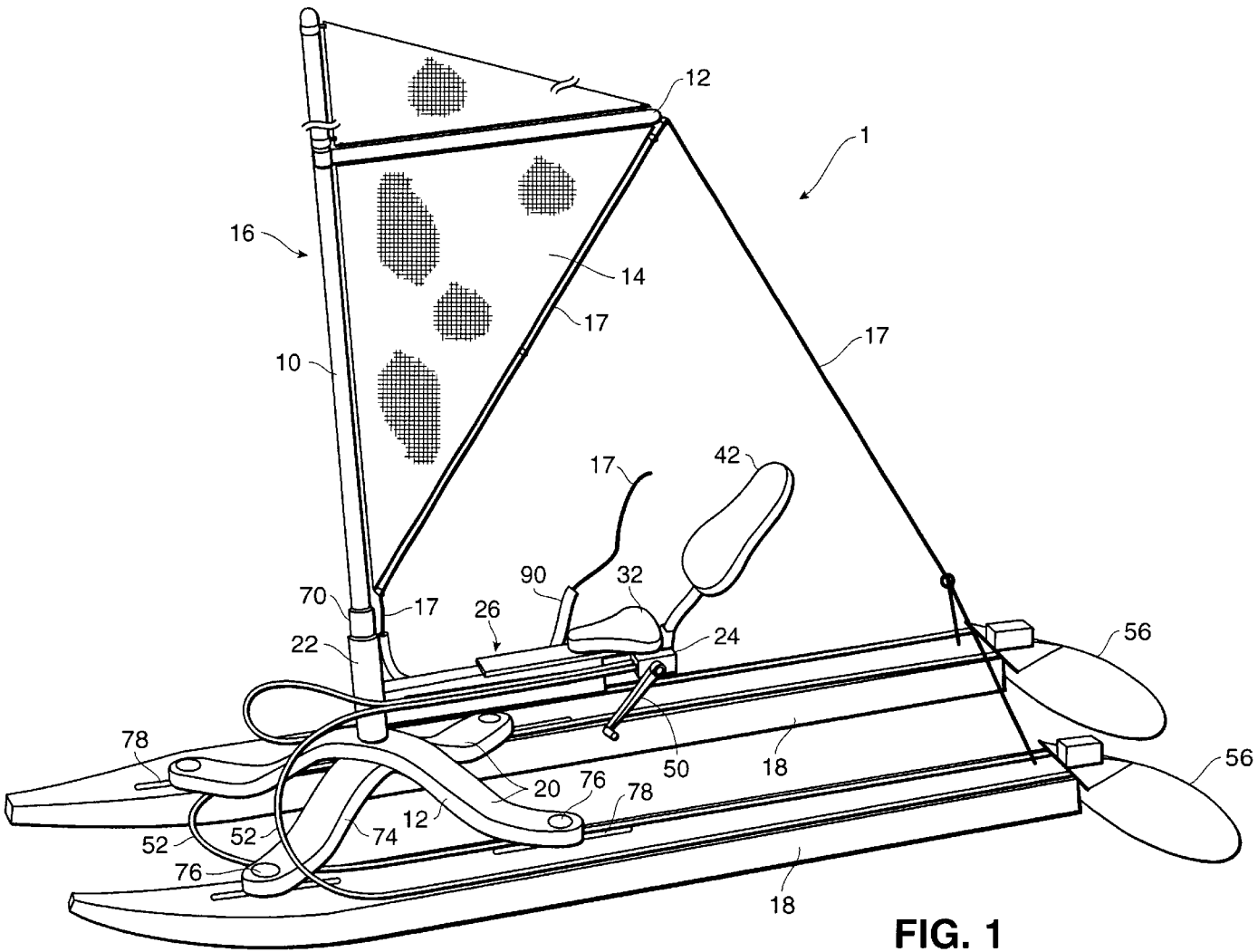
FIG. 1 is a perspective view of a multi-hull sailing vessel with a control system and scissoring base in accordance with the present invention.
Figure 2:
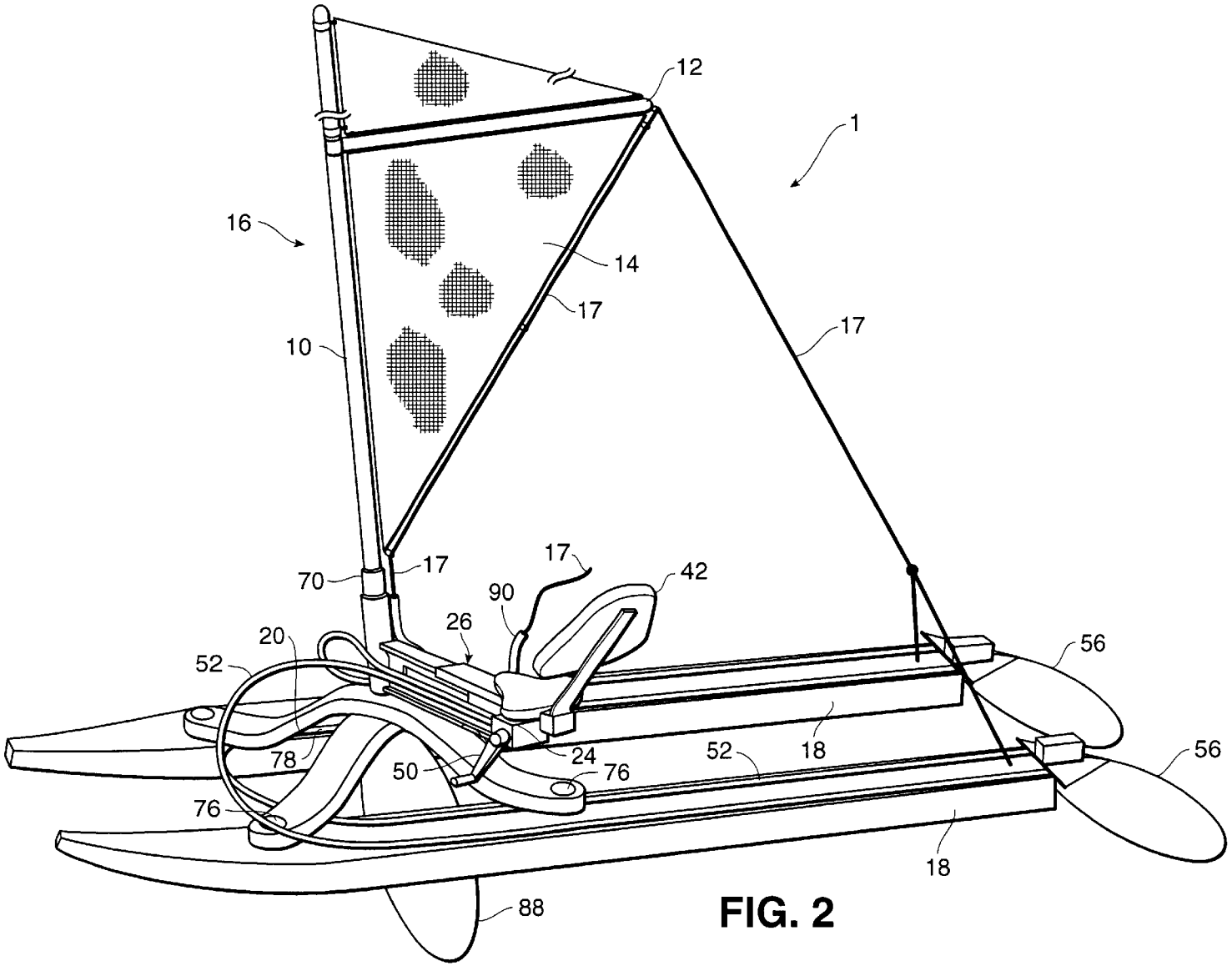
FIG. 2 is an illustrative view of an additional multi-hull sailing vessel having a centerboard with a control system and scissoring base in accordance with the present invention.
Figure 3:
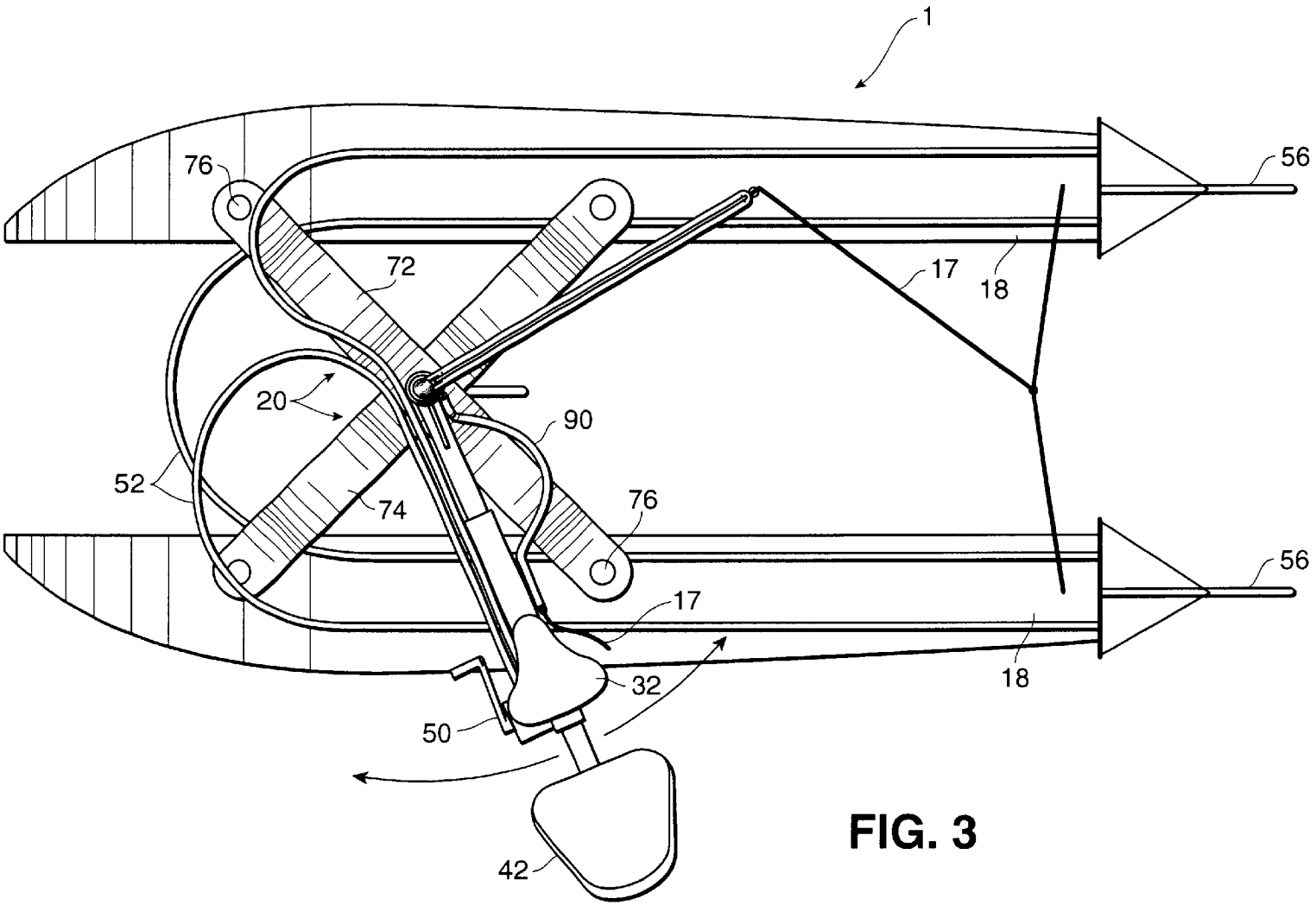
FIG. 3 is a top view of the multi-hull sailing vessel having a center board with a control system and scissoring base shown in FIG. 2.

FIGS. 1–3 illustrate a multi-hull sailing vessel 1 in accordance with the present invention. The multi-hull sailing vessel 1 includes a plurality of hulls 18, a mast 10, an sail assembly 16 including a sail 14 and a boom 12, a steering assembly and a seat assembly 26. As shown in FIGS. 2 and 3, the sailing vessel 1 may also have a keel-like assembly such as a centerboard 88.

The sail 14 attaches along the vertical axis to the mast 10 and to the boom 12. In turn, the mast 10 is affixed at its bottom extremity to a base 20 which extends substantially horizontally between the plurality of hulls 18. The sail 14 is a simple form of an airfoil. In a preferred embodiment, the mast 10, boom 12 and sail 14 forms a sail assembly 16 that can pivot in unison from within a mast sleeve 70 that is secured to the base 20. Note that while the Figures show that the sail assembly 16 pivots as a single unit, a sail can pivot about a fixed mast rather than the whole assembly pivoting without departing from the spirit and scope of the invention.

The multi-hull vessel 1 of the present invention also includes a slidable seat apparatus 24 that is connected at a first extremity by a seat hinge 22 to the base 20 to allow the slidable seat apparatus 24 to rotate about the seat hinge 22. In a preferred embodiment, and as shown in the drawings, the seat hinge 22 is secured directly to the mast sleeve 70 to allow a seat assembly 26 to pivot about the mast sleeve 70. A separate hinge connection could be created to separate the seat connection from the sail connection where it would be advantageous to separate the ballast control pivot point (seat hinge) from the sail pivot point. However, in the preferred embodiment they are made coincident to conserve space and weight. A fixed mast can also function as a viable base and/or pivotal hinge connection as an alternate embodiment of the present invention.

Figure 4:
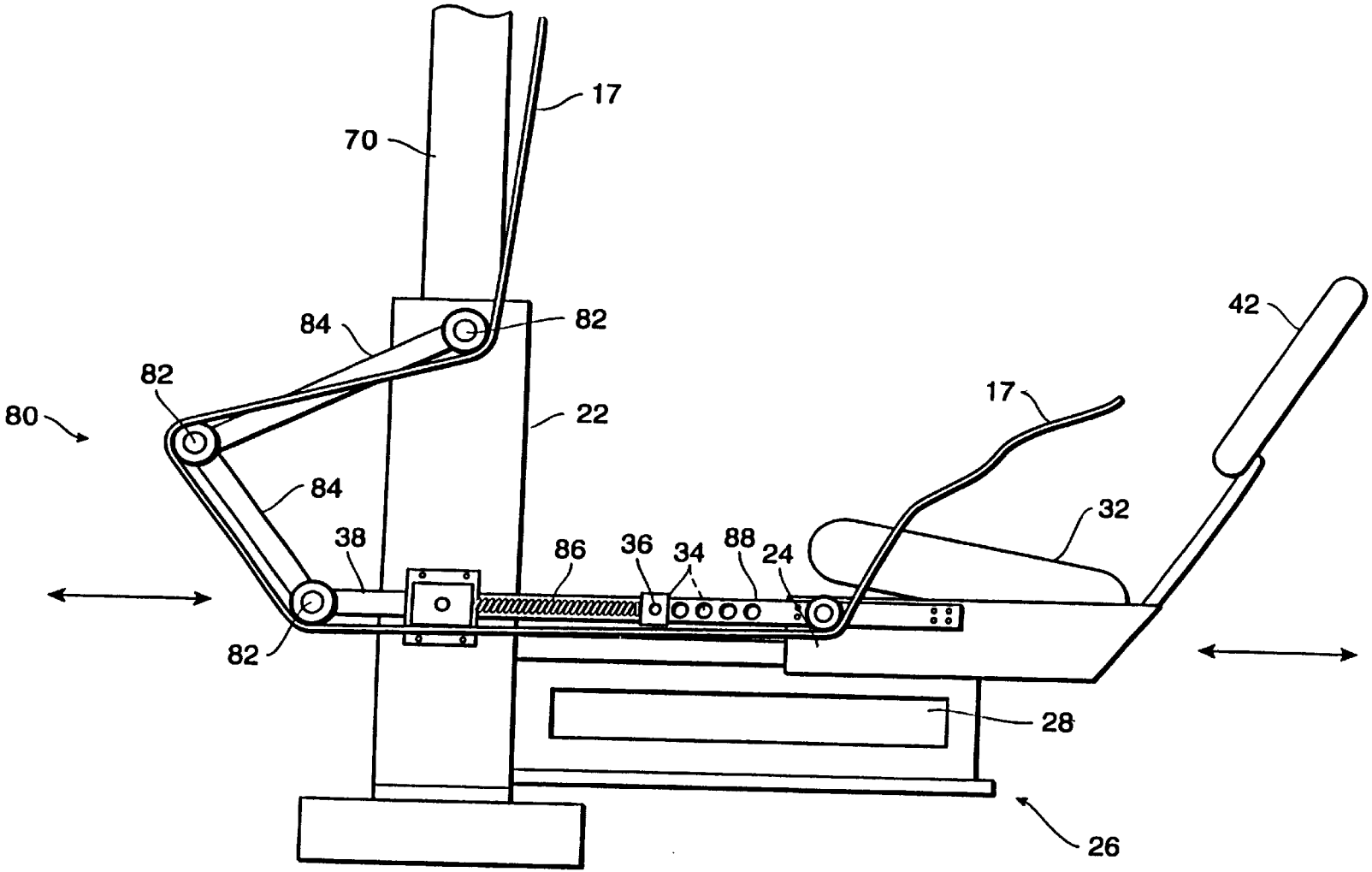
FIG. 4 is a side view of a constant length pulley system for controlling the sail of the multi-hull sailing vessel of the present invention.

As best shown in FIG. 4, a preferred embodiment of the seat assembly 26 includes the slidable seat apparatus 24, a seat hinge 22, and a seat arm 38. Meanwhile, the slidable seat apparatus 24 is comprised of a seat 32, a backrest 42, a seat base 28 and seal rollers 30. The seat apparatus 24 is slidably connected to the seat arm 38. Seat rollers, not shown, may be provided on the seat arm 38 and/or the seat base 28 to provide a sliding connection between the slidable seat apparatus 24 and the seat arm 38.

Preferably, the seat assembly 26 has an adjustment for the length of the seat arm 38 including a telescoping seat linkage member 88 that is fixed with a hand operated seat pin 36. The helmsperson can set the length of the telescoping seat linkage member 88 with the seat pin 36 to accommodate different size or skill levels of helmspersons. Preferably, the seat assembly 26 includes a biasing means 86, such as a compression spring, to force the slidable seat apparatus 24 toward the seat hinge 22 to assist in the moving of the slidable seat apparatus 24 by the pilot, since it is easier to push with one's legs than to pull with one's legs while seated in a recumbent position. A helmsperson can set the slidable seat apparatus 24 as desired. The length of a helmsperson's legs, comfort level and weather conditions would all be factors in determining the settings of the position of the slidable seat apparatus 24.

As shown in FIGS. 1–4, the primary control interface for the control of the sail assembly 16 is the manipulation of the main sheet 17 by the helmsperson while sitting on the seat 32. The main sheet 17, herein also referred to as a line, is a rope, cable or other such type of force transmitting system that limits the pivotal motion of the sail assembly 16. The main sheet 17 of the preferred embodiment is rigged such that by adjusting the length of the main sheet 17, the helmsperson controls the degree that the sail assembly 16 is allowed to pivot. When the helmsperson pulls in the maximum length of the main sheet 17, the sail assembly 16 will be drawn to a position substantially parallel to the hulls 18.

When the wind blows against the sail assembly 16, the sail assembly 16 will pivot to a degree as allowed by the adjustments to the length of the main sheet 17 made by the helmsperson sitting on the seat 32. It is important to note that as the slidable seat apparatus 24 moves slidably or the entire seat assembly 26 moves pivotally, the main sheet 17 is kept at a constant length, thus eliminating the need to adjust the main sheet 17 to compensate for the movement of the sliding seat apparatus 24. Maintaining and independent control of the sail while the seat assembly moves can be accomplished by using numerous means including hydraulics, fixed sleeve and line systems, linkages and line systems. Where a vessel incorporates more than one sail, then the vessel includes controls for adjusting each one.

As shown in FIGS. 1–3, in an additional embodiment, the sail assembly 16 includes a hollow tubular sleeve 90 that attaches at one extremity at the mast 10 and at the second extremity at the slidable seat apparatus 24. The sail assembly 16 further includes a line 17, also known as a mainsheet, which extends from the slidable seat apparatus 24 and then through the tubular sleeve 90. Then, the line 17 runs beyond the tubular sleeve 90 along the trailing edge of the sail 14 to the trailing edge of the boom 12. Thereafter, the line 17 extends downward to terminate at a traveler. The tubular sleeve 90 is constructed to be flexible so as to permit the slidable seat apparatus 24 to move along the seat assembly's arm 38. Moreover, the tubular sleeve 90 is constructed to have a substantially fixed length so that amount of line retained in the tubular sleeve 90 remains constant while the slidable seat apparatus 24 slides along the seat arm 38 and the seat assembly 26 pivots around the mast 10.

Preferably, attached to the seat assembly 26 is a cam cleat (not shown) that is located in proximity to the aft extremity of the sleeve 90 or the constant length pulley 80. In operation, the helmsperson can secure and release the mainsheet 17 with the cam cleat while sailing. Thus, as shown in FIGS. 1–3, a cam cleat located on the starboard side of the seat assembly 26 would enable the helmsperson to utilize their right arm to secure and release the mainsheet 17, and thus control the sail assembly 16 entirely with their right arm.

In a preferred embodiment, the sail is controlled by a constant length pulley system 80. A constant length pulley system 80 can be developed by those skilled in the art using pulley or similar assemblies which provide a means to linearly retrieve, or retract, the mainsheet 17 as the slidable seat apparatus 24 moves. More particularly, the constant length pulley system 80 maintains a constant length of mainsheet 17 as the seat assembly 26 moves leaving the sail assembly 16 in the same position without requiring the helmsperson to adjust the mainsheet 17. For example, as shown in FIG. 4, a constant length pulley system 80 is provided having a plurality of linkages 84 and pulleys 82. As the slidable seat apparatus 24 moves forward, the linkages 84 swivel forward to provide a constant length of the mainsheet 17 leaving the sail assembly 16 in an unmodified position.

The invention is equally applicable where the sail assembly 16 does not use a mainsheet 17. For example, the invention is intended to include seat mounted control systems utilizing hydraulics, electric motors or other force transfer systems which control the pivoting of the sail assembly 16 which is not affected by the movement of the seat 32. Such a system could directly pivot the mast 10 or use an electric, hydraulic or cable sleeve system as described herein.

As shown in FIGS. 1–3, the sailing vessel 1 of the present invention also includes a steering control system using a wheel or other type of lever to transmit a force that is transmitted through the steering lines 52 to pivot the rudders 56. The steering control system may be simply the end of a rope attached to a rudder 56, or as shown in the Figures may include a steering lever 50 that controls the positioning of the rudders 56 by way of the steering lines 52 that connects the steering lever 50 to the rudder assemblies. Manipulation of the steering lever 50 transmits a force applied by the helmsperson through rope, cables, hydraulics, or other such type of force transmitting systems to steering actuators 54 or to the extremities of the rudder assemblies of the type which could be constructed by those skilled in the art, which in turn pivot the rudders 56. Where the steering lines 52 are constructed using sleeves and cable, or hydraulics, the lines will preferably have a constant length that does not vary with the movement of the slidable seat apparatus 24. As shown in the drawings, steering lines 52 are constructed of sleeves for transmitting hydraulic fluid or for receiving lines or cables. The steering lines 52 are constructed with sufficient lengths to move and flex with the movement of the slidable seat apparatus 24. However, the steering lines' 52 overall length do not alter the system upon movement of the slidable seat apparatus 24 which would otherwise affect the control of the rudders 56.

In accordance with the present invention, the steering lines 52 function such that the rudders 56 respond to the force applied by the helmsperson to the steering lever 50, but the rudders 56 are not affected by the position of the slidable seat apparatus 24 to which the seat 32 and steering lever 50 are attached. The steering lines 52 are comprised of force transfer lines that maintain a constant distance between the steering lever 50 and the steering actuators 54. By using lines that transfer a force induced by the steering lever 50 without changing the length of the path conducting the force, as is the case with hydraulic lines, cables through a cable housing, lines through cable sleeves, or lines through a pulley system, the distance and tension or pressure within the lines is not affected by the movement of the lines and controls attached to the slidable seat apparatus 24.

To operate the sailing vessel 1 of the present invention, the helmsperson moves the seat 32 to control his weight as ballast. The helmsperson can position his or her feet on the base 20 or on one or both hulls 18 and push off to coerce the seat 32 to move. The moving of the seat 32 can be used to offset the overturning effects of the wind on the vessel 1. By pushing off substantially equally with both feet the slidable seat apparatus 24 will tend to move slidably along the seat arm 38. When the helmsperson pushes off substantially with only one foot or the other, the entire seat assembly 26 will tend to pivot. Using both feet in combination with varying forces can affect movement to position the helmsperson's weight as ballast at any desired location relative to the hulls 18 within the combined range of motion of the seat assembly 26.

Pivoting the seat assembly 26 about its hinge connection 22 will generally approximate the desired position of the helmsperson's weight as ballast. This effect is characterized by the helmsperson rotating in a circular path about the pivot point. This circular motion tends to approximate the optimal positions to counteract the overturning forces of the wind by allowing the helmsperson to juxtapose his position with the sail's motion. It may be necessary to modify the radius of the circular motion to allow the helmsperson to position his or her weight as ballast at various intermediate positions required at the moment by a combination of dynamic forces common to sailing.

When the wind comes directly from behind, the heeling forces to port or starboard are negligible. Therefore, it is best to position the seat 32 at a neutral position parallel with the hulls 18. Advantageously, this position also places the helmsperson's weight further aft which helps counter balance the wind's driving force that propels the vessel forward, but also affects the pitch and tends to tip the bow down. When the wind is blowing substantially perpendicular to the vessel the heeling forces are at a maximum and the wind forces are minimized in regards to pitch. In this situation, the helmsman would position the seat 32 substantially perpendicular to the hulls 18, but opposite to the wind force. This position is neutral for pitch control yet maximum to control heeling. At positions between these extremes the circular arc traveled by the seat assembly 26 tends to approximate the optimal ballast adjustment. In situations where finer adjustments are desired, the slidable seat apparatus 24 is allowed to travel along seat arm 38 to provide more or less adjustment to pitch and heeling at any time. The manipulation of the length of the main sheet 17 to control the pivoting of the sail assembly 16, the manipulation of the steering lever 50 to control the rudders 56, and the movement of the seat 32 to adjust the helmsperson's weight as ballast, are operable by the helmsperson sitting upon the seat 32 independently and simultaneously regardless of the position of the seat 32.

In accordance with an additional aspect of the invention, the base 20, in conjunction with the sliding hull connection 78, is used to position the hulls 18 at a preselected distance from each other, while at the same time affixing the hulls 18 together. FIGS. 1–3 provide an illustration of the base 20, which is used as the base for the mast 10 in a preferred embodiment. The base 20 is constructed substantially in the form of an "X" and is composed of a pair of arms including an upper scissor member 72, a lower scissor member 74. The upper scissor member 72 and the lower scissor member 74 rotationally connect at the mast sleeve 70 to form a scissoring joint that allows the base 20 to effectively adjust its width. The base 20 is anchored into position by securing base anchor knobs 76 in the sliding hull connections 78. The sliding hull connections 78 allows the base 20 to be moved longitudinally, accordingly allowing seat assembly 26 and sail assembly 16 attached to the base 20 to be moved longitudinally. The overall distance between the hulls 18 can be adjusted for storage and various operating conditions.

By closing the distance between the hulls, the turning response of the sailing vessel is improved. An experienced helmsperson may choose to bring the sailing vessel's hulls closer together for better turning response, where an amateur may sacrifice maneuverability for stability. A larger distance between the hulls will allow all riders more resistance to the overturning forces of the wind, which is especially important when the winds are stronger.

When the base 20 is secured in the sliding hull connections 78, the ends of the base 20 cannot move and thus there is no scissoring. Another advantage of the base 20 is that it allows a helmsperson to set the position of the base 20 and the attached seat and sail assemblies longitudinally in relation to the hulls 18. Additionally in the case of multi-hull vessels, the scissoring base 20 provides a hull connection 78 that enables the operator to control the distance between the hulls 18 for operation and storage.

While the present invention has been described in regards to a preferred embodiment and select others, it is understood that various modifications may be made by those skilled in the art without departing from the scope or spirit of the invention as identified in the appended claims.

I claim:

1. A sailboat for sailing on water comprising:

a boat hull;

a mast assembly for mounting a sail;

a rudder assembly including a rudder for controlling sailing direction of the sailboat;

a seat assembly for use as ballast control means and including a seat for supporting an individual piloting the sailboat, said seat being movable with respect to said mast assembly, wherein said ballast control means allow the pilot's body weight to be used as movable ballast while seated on said movable seat;

a sail controller affixed to said seat for controlling the position of said sail independently of a movement of said seat;

a rudder controller affixed to said seat for controlling the position of said rudder independently of said movement of said seat;

wherein the movement of the seat does not alter the position of said sail or said rudder, and therefore not requiring additional adjustment or compensation of said controllers for maintaining said position of the sail and the rudder.

2. The sailboat of claim 1 wherein said seat assembly rotates about a longitudinal axis of said mast assembly.

3. The sailboat of claim 2 wherein said seat assembly moves radially relative to said mast assembly.

4. The sailboat of claim 1 wherein said sail controller includes:

a flexible tubular hollow sleeve having a first extremity attached to said mast assembly and a second extremity attached to said seat assembly; and a line projecting through said sleeve including a first end and a second end, said first end attached to said sail and said second end extending to said seat assembly.

5. The sailboat of claim 4 wherein said rudder controller includes:

a flexible tubular hollow sleeve having a first extremity attached to said seat assembly and a second extremity extending toward said rudder; and a line projecting through said sleeve including a first end and a second end, said first end extending to said seat assembly and said second end extending to said rudder assembly.

6. The sailboat of claim 1 wherein said sail controller includes:

a line extending from said sail; and a substantially constant length pulley system for maintaining a substantially constant length of said line.

7. The sailboat of claim 6 wherein said rudder controller includes:

a flexible tubular hollow sleeve having a first extremity attached to said seat assembly and a second extremity extending toward said rudder; and a line projecting through said sleeve including a first end and a second end, said first end extending to said seat assembly and said second end extending to said rudder assembly.

8. The sailboat of claim 1 wherein said rudder controller includes:

a flexible tubular hollow sleeve having a first extremity attached to said seat assembly and a second extremity extending toward said rudder; and a line projecting through said sleeve including a first end and a second end, said first end extending to said seat assembly and said second end extending to said rudder assembly.

9. The sailboat of claim 1, wherein said boat hull comprises first and second hulls for providing adjustable width to the sailboat, with each hull having a longitudinal axis extending along its length; and a base for connecting said first and second boat hulls, said base including first and second arms with each arm having first and second extremities and a midpoint defining the position substantially half-way between the first and second extremities, said two arms being rotatably joined together substantially near their midpoints to form a scissor joint, said first extremities of said first and second arms attaching to said first boat hull and said second extremities of said first and second arms attaching to said second boat hull, at least said first extremities of said arms or said second extremities of said arms being adjustable to move along said longitudinal axis of said first and second boat hulls while said first and second arms rotate relative to one another in scissor fashion to provide adjustment of the distance between said first hull to said second hull.

10. The multi-hull boat of claim 9 further comprising:

locking means for locking said first and second arms in at least one locked position.

11. The multi-hull boat of claim 10 wherein said locking means can lock said arms in an extended position with said first and second boat hulls being locked in a position with a maximum distance between them, and said locking means can lock said arms in at least one retracted position with said first and second boat hulls being locked in a position not having a maximum distance between them.

12. The multi-hull boat of claim 9 further comprising:

said mast extending vertically from said base; and said first and second extremities of said first and second arms being adjustable to move along said longitudinal axis of said first and second boat hulls to permit the mast to be moved along the longitudinal axis of said boat.

* * * * *